US006861931B1

(12) United States Patent
Corliss et al.

(10) Patent No.: US 6,861,931 B1
(45) Date of Patent: Mar. 1, 2005

(54) PORTABLE REMOTE CONTROL CIRCUIT BREAKER SYSTEM

(76) Inventors: Joseph J. Corliss, 23508 Sugar View Dr., Clarksburg, MD (US) 20871; Daniel E. Gannon, 541 W. Montgomery Ave., Rockville, MD (US) 20850

( * ) Notice: Subject to any disclaimer, the term of this patent is extended or adjusted under 35 U.S.C. 154(b) by 0 days.

(21) Appl. No.: 10/788,981

(22) Filed: Mar. 1, 2004

(51) Int. Cl.[7] ..... H01H 77/00
(52) U.S. Cl. ..... 335/14; 361/191; 307/113
(58) Field of Search ..... 335/14, 20, 68–70, 335/159–161; 361/191; 307/112–115

(56) References Cited

U.S. PATENT DOCUMENTS 4,965,694 A * 10/1990 Dvorak et al. ..... 361/64
5,301,083 A 4/1994 Grass et al.
5,373,411 A 12/1994 Grass et al.
5,477,016 A 12/1995 Baginski et al.
5,821,876 A * 10/1998 Farrington et al. ..... 340/3.2
6,034,581 A 3/2000 DiMarco et al.
6,157,527 A 12/2000 Spencer et al.
6,787,937 B2 * 9/2004 Mody et al. ..... 307/115

* cited by examiner

*Primary Examiner*—Lincoln Donovan
(74) *Attorney, Agent, or Firm*—Norman Rainer

(57) ABSTRACT

A system for remotely manipulating circuit breakers between open and closed conditions in an electrical panel having a number of circuit breakers in a vertical array includes an activator unit removably attachable to the panel and having an elongated shaft equipped with a series of control switches adjustably spaced apart to interact with the circuit breakers. A motorized drive feature achieves controlled axial rotation of the shaft to a sufficient extent to cause effective movement of selected circuit breakers. A wireless control unit activates the drive feature to rotate the shaft in either direction to move the circuit breakers to their open or closed positions.

8 Claims, 2 Drawing Sheets

PORTABLE REMOTE CONTROL CIRCUIT BREAKER SYSTEM

BACKGROUND OF THE INVENTION

1. Field of the Invention

This invention relates to a system for remotely controlling the open/close status of individually selected circuit breakers in a panel of such circuit breakers which provide overload current protection.

2. Description of the Prior Art

Circuit breakers provide overcurrent protection for preventing personal injury and property damage. A loadcenter or panelboard receives electrical power from the utility company transformer and routes the electrical power through a main circuit breaker and then through branch circuit breakers to designated branch circuits, each supplying current to one or more electrical loads. The circuit breakers are designed to interrupt the electrical current if it is excessive or outside the design limits of the conductor and loads, to reduce the risk of injury and damage. Branch circuit breakers are provided in narrow width molded cases which fit into designated slots or pole openings in the panelboard.

A circuit breaker has a thermal/magnetic trip characteristic. The thermal characteristic is operative in response to overload current of extended duration which heats a bimetal member, causing movement of the latter, which in turn releases a latch to trip open a set of contacts. For example, the thermal characteristic would respond to 30 amps being drawn in a 15 amp circuit. The magnetic characteristic is operative in response to a sudden high magnitude current overload condition, and uses the magnetic field generated in a magnetic core to attract an armature, which movement releases the latch to open the contacts. As an example, the magnetic type actuation occurs in response to a short circuit wherein the hot line conductor becomes directly connected with ground or neutral, bypassing the load.

It is known in the prior art to provide remote controlled circuit breakers wherein the breaker contacts are tripped to an open condition by an actuator responding to a control signal. This enables the circuit breaker to additionally perform a switching function and manage a load connected to the breaker, such that the breaker performs the dual functions of overload current protection and load management. Such systems are disclosed for example in U.S. Pat. No. 6,034,581 for controlling lighting systems based upon the time of day and ambient light; and in U.S. Pat. No. 5,373,411 which utilizes a circuit breaker panel to control household appliances.

However, a disadvantage of using the breaker contacts to perform such switching relay type function is that the breaker contacts are designed to interrupt high current, not for repeated operation. Also, such prior systems for remotely operating a panel of circuit breakers requires wired connection between the panel and sensors which deliver a monitoring signal to the panel. Such wiring is generally impractical unless installed into a building at the time of its construction. Even so, it is a costly installation.

U.S. Pat. No. 5,477,016 to Baginski et. al. discloses a control unit having mechanical features adapted to move the circuit breaker between open and closed states. However, the add-on unit is intended as a permanent installation which permits locking of the circuit breakers in their open position.

When an electrician is working on features of the electrical system of a residential or commercial building, he often finds it necessary to turn the electrical service on and off at the appropriate circuit breaker. Considerable time is wasted in going back and forth to verify or change the status of circuit breakers.

It is accordingly an object of the present invention to provide a system for remotely controlling circuit breakers in an electrical panel having a number of said circuit breakers.

It is another object of this invention to provide a remote control system as in the foregoing object having mechanical components which are removably installable upon said panel.

It is a further object of the present invention to provide a remote control system of the aforesaid nature which additionally provides remote verification of the status of said circuit breakers.

It is still another object of this invention to provide a remote control system of the aforesaid nature which is inexpensive and easy to use.

These objects and other objects and advantages of the invention will be apparent from the following description.

SUMMARY OF THE INVENTION

The above and other beneficial objects and advantages are accomplished in accordance with the present invention by a system for remotely manipulating circuit breakers between open and closed conditions in an electrical panel having a number of circuit breakers in a vertical array, each circuit breaker having a manipulating lever, said system comprising:

A) an actuator unit removably attachable to said panel and comprising:

1) a rigid shaft elongated upon a straight axis between upper and lower extremities, 2) a series of control switches mounted upon said shaft, and adjustably spaced apart by distances corresponding to the locations of said circuit breakers, and 3) motorized drive means associated with at least one extremity of said shaft and adapted to rotate said shaft in either direction upon said axis, said rotation causing said control switches to move said circuit breakers to their on or off positions, and B) a wireless remote control unit capable of energizing said drive means to rotate said shaft in one direction so as to turn off selected circuit breakers, and rotate in the opposite direction so as to turn on said same selected circuit breakers.

In a preferred embodiment, the remote control unit is a radio transmitter, and the motorized drive means includes an electric motor equipped with radio signal receiving means capable of producing electrical activation of the motor. A motor may be associated with each extremity of the shaft, adapted to rotate the shaft in opposite directions. In a further preferred embodiment, indicator means are associated with each control switch for conveying a position-verifying signal back to said remote control unit. The actuator unit is preferably equipped with magnets at the extremities of said shaft for achieving rapid removable attachment to said electrical panel. Each control switch is provided with means to disengage from rotative drive by said shaft.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
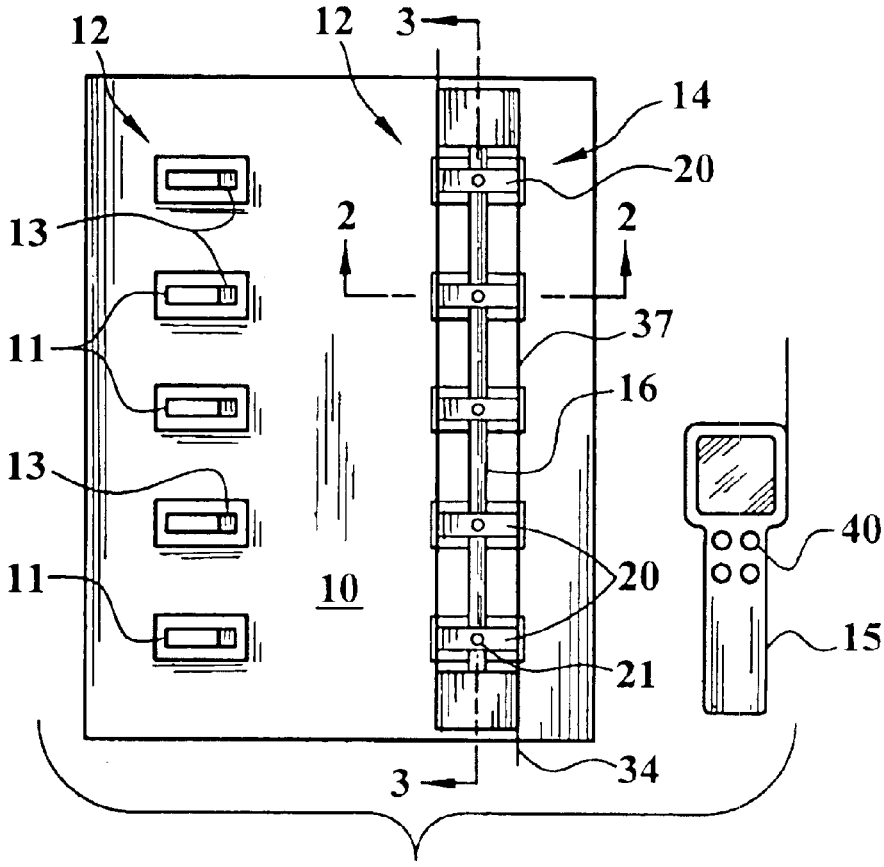
FIG. 1 is a front view of an embodiment of the control system of the present invention shown in functional association with a conventional electrical panel.
Figure 2:
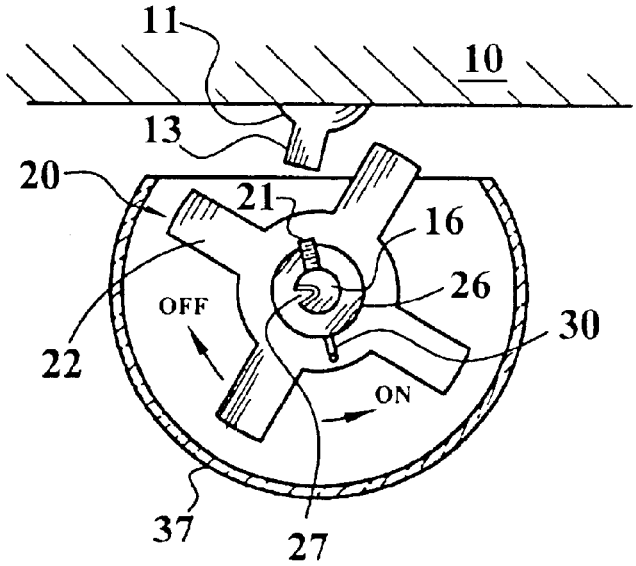
FIG. 2 is an enlarged sectional view taken in the direction of the arrows upon the line 2—2 of FIG. 1.
Figure 3:
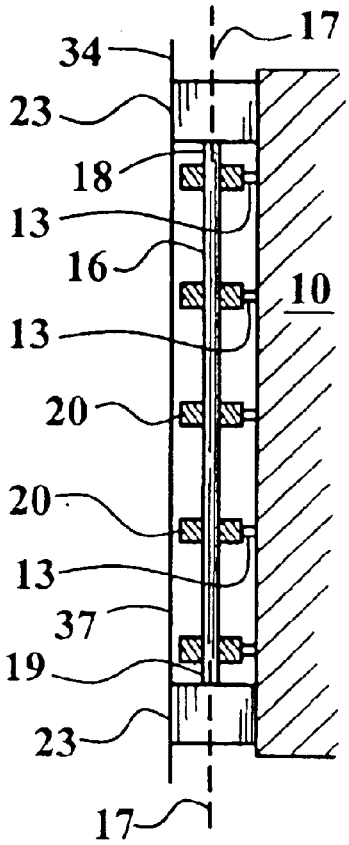
FIG. 3 is a sectional side view taken in the direction of the arrows upon the line 3—3 of FIG. 1.
Figure 4:
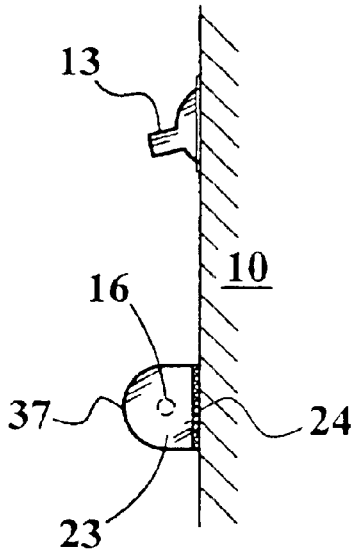
FIG. 4 is a top view of the embodiment of FIG. 1.

Referring now to FIG. 1, a circuit breaker enclosure panel 10 of commonplace design is shown equipped with a number of circuit breakers 11 of conventional design arranged in two vertical arrays 12. Each circuit breaker has a manipulating lever 13 moveable between two opposite extremes representing open and closed conditions of the electrical circuit controlled by each circuit breaker. An example of a typical circuit breaker enclosure panel is NEMA Type 1 surface mount made by the Square D Company. Such panels are adapted to accommodate type QO Square D plug-in circuit breakers.

An embodiment of the control system of the present invention comprised of actuator unit 14 and associated remote control unit 15, is shown in FIG. 1 in functional association with circuit breaker enclosure panel 10. Said actuator unit is comprised of rigid shaft 16 elongated upon straight axis 17 between upper and lower extremities 18 and 19, respectively, which are interactive with electrical motors 23. The actuator unit is removably attached to panel 10 by way of magnets 24 associated with the rear of the motors.

A series of control switches in the form of toggle wheels 20 are slideably positionable upon said shaft, preferably by way of splined engagement with the shaft. Locking means, which may be in the form of an Allen bolt 21 enables the toggle wheel to be secured at any chosen location of a circuit breaker sought to be controlled.

Figure 5:
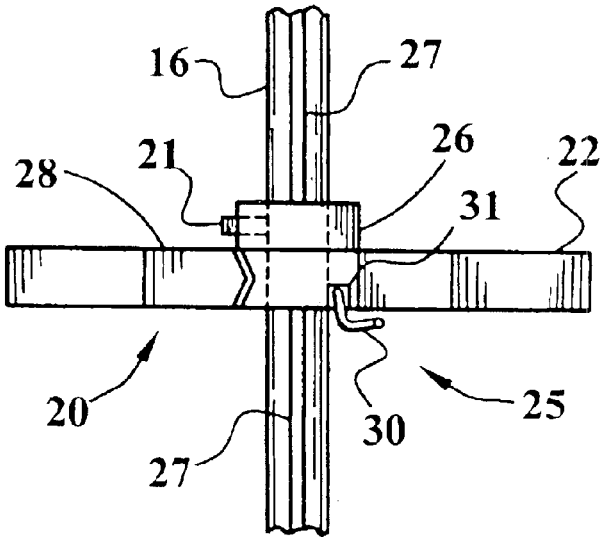
FIG. 5 is an enlarged fragmentary side view of a component of said control system.

Each toggle wheel 20 is comprised of several arms 22 radially directed from a center hub 28. The length of the arms is adequate to contact the manipulating lever 13 of the designated circuit breaker. Release means 25 may also be associated with each toggle wheel in a manner whereby the toggle wheel can be made not to be driven by rotation of said shaft. An embodiment of such release means 25 is shown in FIG. 5 wherein a collar 26 is associated with toggle wheel 20. Said collar is adapted to slide axially upon shaft 16 by way of engagement with spline groove 27 in said shaft, and is securable to said shaft by way of Allen bolt 21. A latch 30, mounted by pivot means 32 to the flat side of hub 28, is adapted to insert into recess 31 in he flat side of said collar. Latch 30 maintains its position by virtue of frictional force at said pivot means. When unlatched, toggle wheel 20 is freely rotative upon shaft 16. A transparent plastic cover 37 extends in joinder between the opposite motorized extremities of the actuator unit.

In operation, rotation of shaft 16 in one direction by motor 23 causes toggle wheels 20 to contact designated manipulating levers 13, causing said levers to be pushed to their on or off positions. Reverse rotation of the shaft causes said levers to be pushed to their opposite positions. The motors are activated by remotely transmitted signals which are received by antennas 34 associated with each motor. By way of such manner of operation, selected circuit breakers 11 can be turned on or off remotely.

Remote control unit 15 has button switches 40 for activating motor 23 to cause rotation of shaft 16 about 180 degrees in either direction. Such rotation causes arms 22 of rotatable toggle wheels to move the manipulating lever 13 of an associated circuit breaker between open and closed positions. The radio transmitting means for said remote control unit 15, and the compatible signal receiving means may be based upon equipment commonly employed for the radio-controlled opening and closing of garage doors. Such transmitters, as model T80G manufactured by the Telectron Company, have two buttons for activation of a remote mechanism in opposite directions, and operate on a nine volt battery. The transmission range, at 225 MHz frequency, is about 50 yards.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. A system for remotely manipulating circuit breakers between open and closed conditions in an electrical panel having a number of circuit breakers in a vertical array, each circuit breaker having a manipulating lever, said system comprising:

A) an actuator unit removably attachable to said panel and comprising:
   1) a rigid shaft elongated upon a straight axis between upper and lower extremities,
   2) a series of control switches mounted upon said shaft, and adjustably spaced apart by distances corresponding to the locations of said circuit breakers, and
   3) motorized drive means associated with at least one extremity of said shaft and adapted to rotate said shaft in either direction upon said axis, said rotation causing said control switches to act upon said manipulating levers to move said circuit breakers to their on or off positions, and B) a wireless remote control unit capable of energizing said drive means to rotate said shaft in one direction so as to turn off selected circuit breakers, and rotate in the opposite direction so as to turn on said same selected circuit breakers.

2. The system of claim 1 wherein said wireless remote control unit is a radio transmitter.

3. The system of claim 2 wherein said motorized drive means includes an electric motor equipped with radio signal receiving means capable of activating said motor.

4. The system of claim 1 wherein a motor is associated with each extremity of said shaft, and adapted to rotate said shaft in opposite directions.

5. The system of claim 1 further including indicator means associated with each control switch for conveying a position-verifying signal back to said remote control unit.

6. The system of claim 3 wherein each extremity of said shaft is equipped with magnetic means for achieving rapid removable attachment to said electrical panel.

7. The system of claim 1 wherein each control switch is provided with means to disengage from rotative drive by said shaft.

8. The system of claim 1 wherein said shaft is capable of 180 degrees of rotation in either direction.

* * * * *